US007153553B2

(12) United States Patent
Tetrault

(10) Patent No.: US 7,153,553 B2
(45) Date of Patent: Dec. 26, 2006

(54) SYNTHETIC TURF HAVING COOLING LAYER

(76) Inventor: Christopher Tetrault, 3203 Jenny Lind Rd., Amelia, OH (US) 45102-2321

( * ) Notice: Subject to any disclaimer, the term of this patent is extended or adjusted under 35 U.S.C. 154(b) by 0 days.

(21) Appl. No.: 10/906,116

(22) Filed: Feb. 3, 2005

(65) Prior Publication Data

US 2006/0172092 A1 Aug. 3, 2006

(51) Int. Cl.
*A41G 1/00* (2006.01)

(52) U.S. Cl. ..... 428/17

(58) Field of Classification Search ..... 428/25, 428/23, 17, 16

See application file for complete search history.

(56) References Cited

U.S. PATENT DOCUMENTS 4,044,179 A 8/1977 Haas, Jr.
4,396,653 A 8/1983 Tomarin
5,868,087 A * 2/1999 Salestrom ..... 111/132
6,299,959 B1 * 10/2001 Squires et al. ..... 428/87
6,689,447 B1 * 2/2004 Prevost ..... 428/87
6,740,387 B1 5/2004 Lemieux
6,800,339 B1 10/2004 Motz et al.
2003/0118755 A1 6/2003 Motz et al.
2004/0086664 A1 * 5/2004 Seaton ..... 428/17
2004/0229007 A1 * 11/2004 Motz et al. ..... 428/92
2005/0118383 A1 * 6/2005 Cargill et al. ..... 428/68

* cited by examiner

*Primary Examiner*—Jennifer C. McNeil
*Assistant Examiner*—Gordon R. Baldwin
(74) *Attorney, Agent, or Firm*—Lafkas Patent LLC; David M. Lafkas

(57) ABSTRACT

The present invention describes a synthetic turf having super absorbent materials in order to keep the synthetic turf cooler than conventional synthetic turfs.

15 Claims, 1 Drawing Sheet

SYNTHETIC TURF HAVING COOLING LAYER

The present invention relates generally to synthetic turf for landscaping and athletic fields, and more particularly to synthetic turf having a cooling layer to substantially dissipate heat buildup common with synthetic turf.

Traditionally, athletic fields, as well as landscaped areas for homes and businesses, are covered with a natural grass covering. The natural grass is advantageous for cushioning and ability to quickly recover from abuse from weather, people or both.

In recent years, however, many athletic fields have been converted from natural grass to synthetic turf coverings. The reasons for converting to synthetic turf is most often linked to the high costs and time related to maintaining natural grass. Further, natural grass may have problems growing in certain environmental and man-made conditions, such as for example, desert regions, spaces shaded by buildings, domed fields and high traffic areas. In areas where the natural grass cannot grow properly or adequately, injuries can result from inadequate footing. In addition, poorly growing natural grass is typically not aesthetically pleasing.

Synthetic turf coverings have improved over the years to appear more like natural grass coverings. Other improvements have been made to give more cushioning and elasticity to the synthetic turf to make it more equal to the advantages of natural grass turf.

However, a primary disadvantage of synthetic turf coverings still exists. In particular, most synthetic turf coverings are comprised primarily of plastics, such as, for example, polyethylene. Such plastics absorb, retain and give off heat that can increase the temperature on a field to a potentially fatal level. Even the American Academy of Pediatrics has identified infill artificial turf as contributing to elevating a person's core body temperature, thereby leading to heat related injuries such as, for example, heat cramps, heat exhaustion and heat stroke.

It has been found that naked synthetic turf coverings, that is, synthetic tuft coverings without infill material, such as, for example, sand and rubber, can reach temperatures of 140° F. or greater. Natural grass coverings measure about 85° F. under similar circumstances. Essentially, the materials comprising most synthetic turf coverings absorb heat from the sun and retain the heat to a much greater extent than natural grass coverings. Sand and rubber granules have been used as infill to increase footing and playability of athletic fields, but such infill materials do not mitigate heating issues of infill artificial tuft. In fact, rubber infill may actually contribute to increasing the temperature of the artificial turf. Lighter colored rubber granules and wetting the sand infill have been proposed as a mean by which to try and decrease the overall temperature of the synthetic turf covering, however, such proposals tend to cool the artificial turf for a very limited time and only at an almost insignificant temperature change.

In addition to being related to increasing heat-related injuries, synthetic turf coverings also are associated with heat pollution. The massive amount of heat rising from urban areas is increasingly being linked to both a delay and stimulation of precipitation. Some areas are experiencing a noticeable decrease in much needed rain and snow, while other areas are seeing an increase. There is strong support that heat and pollution from urban areas effects climate in an alarming way; primarily by redistributing water in an undesired fashion.

As such, governments are considering and implementing environmental standards to limit the heat generated from urban areas. Some of the standards call for increased natural green spaces and fewer areas of blacktop and concrete, that is, artificial spaces that buildup and give off great amounts of heat pollution. Typical synthetic turf coverings can behave very much like blacktop when it comes to heat pollution.

Attempts have been made to decrease the temperature of synthetic turf coverings. Attempts to cool synthetic tuft coverings include watering down the coverings. However the water quickly evaporates. More recent attempts include mechanical means in which a series of cooling pipes are constructed under the synthetic turf coverings. However, such mechanical means is expensive and would require removing currently laid synthetic turf coverings.

Ceramic beads having about 50% porosity have been combined with sand and rubber granules to supplement mechanical cooling systems as a means for cooling artificial turf coverings. However, the ceramic beads are unable to hold enough water to significantly decrease the temperature of the synthetic turf covering. Lighter colored rubber has also been proposed as a means for decreasing the temperature of the synthetic turf covering, but also does not lend to significantly decreasing the overall temperature of the synthetic turf covering.

Thus, what is needed is an economically affordable means for cooling both new and established synthetic turf coverings over a significant period of time and is environmentally friendly.

SUMMARY

The various exemplary embodiments of the present invention include a synthetic turf covering comprising a foundation, a plurality of grass-like pile filaments and a particulate infill. The foundation has a topside and a bottom side and the plurality of grass-like filaments are attached to the foundation and extend substantially upward from the topside of the foundation. The particulate infill comprises a super absorbent material.

The various exemplary embodiments of the present invention further includes a method of cooling a synthetic turf covering comprising introducing a particulate infill between grass-like filaments of the synthetic turf covering. The particulate infill comprises a super absorbent material. Liquid is then applied such that the super absorbent material increases density about 200 to about 400 times.

BRIEF DESCRIPTION OF DRAWING

Various exemplary embodiments of the present invention, which will become more apparent as the description proceeds, are described in the following detailed description in conjunction with the accompanying drawing, in which.

DETAILED DESCRIPTION

Figure 1:
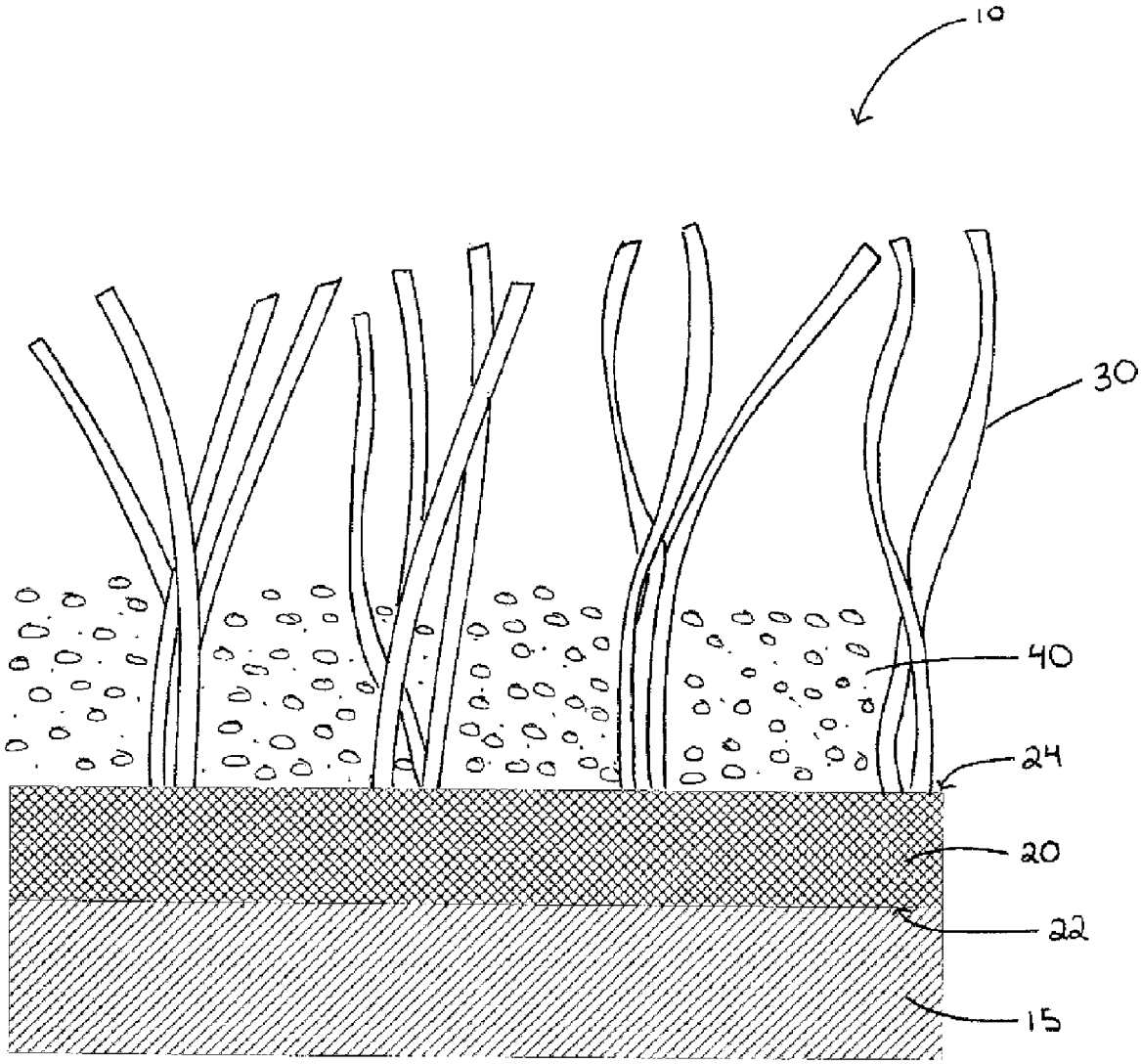
FIG. 1 is an illustrated representation of an exemplary embodiment of the present invention.

FIG. 1 is an illustration of an exemplary embodiment of a synthetic turf covering 10 of the present invention. As shown, the synthetic turf covering comprises a backing layer 20 resting upon a foundation layer 15.

The foundation layer may be bare ground, gravel, sand, rubber or a combination thereof with stone or other similar materials in order to provide support and adequate drainage for the synthetic turf covering.

The foundation layer may be slightly angled towards strategically placed drain pipes to better and faster drying of the synthetic turf covering's top surface after rain or melted snow.

The backing layer may comprise of any known woven or unwoven fabric to which grass-like filaments 30 may be attached. Examples of conventional backing layers include woven warp type strands and cross or woof type strands to produce a woven sheet. The woven sheet may be coated with a rubber-type coating on a topside 24, a bottom side 22 or both. It is preferred that the backing layer comprise of a stable, weather resistant material such as polypropylene, nylon, or similar material.

The backing layer is preferably supple and flexible such that it may conform to the foundation layer and potentially give when impacted.

Grass-like filaments 30 are attached to the backing layer such that the grass-like filaments extend upward, away from the foundation layer and backing layer. The grass-like filaments may be groups of filaments individually attached to the backing layer or thick individual filaments that are split at the top to give the appearance of numerous individual fibers.

The grass-like filaments may vary in thickness and size to give an appearance of natural grass. Typically, the grass-like filaments are comprised of polypropylene or the like.

Any known foundation layer, backing layer and grass-like filaments may be used in the various exemplary embodiments of the present invention.

A particulate infill 40 is introduced once the backing layer with attached grass-like filaments is laid over the foundation layer. The particulate infill is applied to any desired depth. In a preferable exemplary embodiment, the particulate infill comprises greater than about 10% of an average height of the grass-like filaments to about 90% of the average height of the grass-like filaments. In another preferable exemplary embodiment, the particulate infill comprises greater than about 25% of an average height of the grass-like filaments to about 75% of the average height of the grass-like filaments The particulate infill comprises one or more hydrophilic materials, such as, for example, one or more super absorbent polymers such as, for example, polyacrylamide or polyacrylate. Preferably the hydrophilic material swells in water or other introduced liquids to about 200 to about 400 times its density. It is also preferred that the hydrophilic material is nontoxic and biodegradable.

When the super absorbent polymers are contacted with water, the super absorbent polymers increase dramatically in size. Depending on the granule size, the super absorbent polymers may reach maximum moisture retention in as quickly as about ten minutes. After reaching maximum moisture retention the retained moisture slowly releases from the super absorbent polymers depending on the particular conditions present, such as, for example, ambient temperature, sunlight, humidity, etc. Typically, the moisture evaporates from the super absorbent polymers and thereby keeps the backing layer and grass-like filaments cool.

Super absorbent polymers are available as various sizes of granules, and any size granule may be comprised in the particulate infill. The larger the granule, the slower it degrades. However, the smaller the granule, the faster it hydrates.

In a preferred exemplary embodiment, the super absorbent polymers have a granule size of about 2 mm to about 4 mm.

The life of the super absorbent polymers depends on various conditions, including, for example, adjacent soil conditions, microbes that feed on the super absorbent polymers, foot traffic, weather conditions and the like. Some super absorbent polymers may have a life of several years and have an estimated cost of less than about one third of a comparative amount of rubber granules.

The particulate infill may further comprise sand, rubber granules, ceramic beads, soil and combinations thereof.

It in various exemplary embodiments of the present invention, when combining super absorbent polymers with sand, rubber granules, ceramic beads, soil or combinations thereof, the particulate infill is substantially homogeneous. That is, for example, it is preferred in various exemplary embodiments that the particulate infill not be divided into various layers of materials.

The particulate infill materials, in conjunction with the grass-like filaments attached to the backing layer, tend to mutually stabilize and hold one another in predetermined position. However, as the super absorbent polymers change size depending on moisture conditions, there is some shifting of the particulate infill materials.

When the super absorbent polymers are at a maximum moisture retention, the super absorbent polymers are more flexible and absorb imparted impacts more effectively, thereby potentially reducing injuries to individuals hitting the synthetic turf covering. The overall desired flexibility of impact absorption and playing characteristics desired by a synthetic turf covering may be manipulated by varying the percentage of super absorbent polymers in the particulate infill.

Maintenance of particulate infill of the various exemplary embodiments of the present invention is very low. Depending on the size of super absorbent polymer comprising the particulate infill, the particulate infill is replenished annually or every several years as the super absorbent polymer degrades.

When combining soil in the particulate infill, natural grass may be grown within and through the synthetic turf covering. The natural grass may provide a more realistic appearance to the synthetic turf covering.

The particulate infill of the exemplary embodiments of the present invention may be applied to any new or existing synthetic turf coverings. The synthetic turf covering may further comprise an underground sprinkler system for applying water to the super absorbent polymers as needed.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A synthetic turf covering, comprising:

a foundation, wherein the foundation comprises a topside and a bottom side;

a plurality of grass-like pile filaments attached to the foundation and extending substantially upward from the topside of the foundation; and a particulate infill, wherein the particulate infill comprises a super absorbent polymer—comprising a granule size of about 2 mm to about 4 mm.

2. The synthetic turf covering according to claim 1, wherein the super absorbent polymer—is polyacrylamide.

3. The synthetic turf covering according to claim 1, wherein the super absorbent polymer—is polyacrylate.

4. The synthetic turf covering according to claim 1, wherein the super absorbent polymer—is nontoxic and biodegradable.

5. The synthetic turf covering according to claim 1, wherein the super absorbent polymer—increases density about 200 to about 400 times when contacted with liquid.

6. The synthetic turf covering according to claim 1, wherein the particulate infill further comprises sand, rubber granules, ceramic beads, soil or combinations thereof.

7. The synthetic turf covering according to claim 1, wherein the particulate infill is substantially homogeneous.

8. The synthetic turf covering according to claim 1, wherein the particulate infill is applied to greater than about 10% of an average height of the grass-like filaments to about 90% of the average height of the grass-like filaments.

9. A method of cooling a synthetic turf covering comprising: providing a synthetic turf covering, wherein the synthetic turf comprises: a foundation, wherein the foundation comprises a topside and a bottom side; a plurality of grass-like pile filaments attached to the foundation and extending substantially upward from the topside of the foundation; and introducing a particulate infill between the grass-like pile filaments of the synthetic turf covering, where in the particulate infill comprises a super absorbent polymer comprising a granule size of about 2 mm to about 4 mm; and applying liquid such that the super absorbent polymer increases density about 200 to about 400 times.

10. The method according to claim 9, wherein the super absorbent polymer—is polyacrylamide.

11. The method according to claim 9, wherein the super absorbent polymer—is polyacrylate.

12. The method according to claim 9, wherein the super absorbent polymer—is nontoxic and biodegradable.

13. The method according to claim 9, wherein the particulate infill further comprises sand, rubber granules, ceramic beads, soil or combinations thereof.

14. The method according to claim 9, wherein the particulate infill is substantially homogeneous.

15. The method according to claim 9, wherein the particulate infill is applied to greater than about 10% of an average height of the grass-like filaments to about 90% of the average height of the grass-like filaments.

* * * * *